US006123121A

United States Patent [19]

Forslund et al.

[11] Patent Number: 6,123,121

[45] Date of Patent: Sep. 26, 2000

[54] DISTRIBUTING DEVICE FOR PAPER PULP

[75] Inventors: Kjell Forslund; Anders Bergdahl, both of Sundsbruk; Klas Kriström, Kovland; Alf Lindström, Sundsbruk, all of Sweden

[73] Assignee: Valmet Fibertech Aktiebolag, Sweden

[21] Appl. No.: 09/202,763

[22] PCT Filed: May 29, 1997

[86] PCT No.: PCT/SE97/00919

§ 371 Date: Dec. 21, 1998

§ 102(e) Date: Dec. 21, 1998

[87] PCT Pub. No.: WO97/49861

PCT Pub. Date: Dec. 31, 1997

[30] Foreign Application Priority Data

Jun. 27, 1996 [SE] Sweden ..... 9602567

[51] Int. Cl.[7] ..... B65B 1/04

[52] U.S. Cl. ..... 141/113; 141/286; 239/687

[58] Field of Search ..... 141/113, 286, 141/67, 2, 18; 239/687

[56] References Cited

U.S. PATENT DOCUMENTS

| | | | |
|---|---|---|---|
| 2,764,011 | 9/1956 | Richter . | |
| 4,621,507 | 11/1986 | Lundqvist . | |
| 5,366,288 | 11/1994 | Dahllof et al. | 366/176 |
| 5,399,198 | 3/1995 | Ghaisas | 239/687 |
| 5,988,234 | 11/1999 | Wegman | 141/67 |

*Primary Examiner*—Steven O. Douglas
*Attorney, Agent, or Firm*—Lerner, David, Littenberg, Krumholz & Mentlik, LLP

[57] ABSTRACT

Apparatus is disclosed for distributing a flow of pulp uniformly into a container including an inlet for the pulp flow into one end of the container, a cylindrical wall laterally defining a distribution chamber for the container, a planar wall within the container facing the inlet spaced from the cylindrical wall and extending laterally at least to a location corresponding to the cylindrical wall, thus defining a gap between the planar wall and the cylindrical wall so the pulp flow can pass laterally through the gap into the container for distribution therein, and a movable wall associated with the cylindrical wall for adjusting the size of the gap.

9 Claims, 2 Drawing Sheets

DISTRIBUTING DEVICE FOR PAPER PULP

FIELD OF THE INVENTION

The present invention relates to an apparatus for distributing pulp in connection with the supply of pulp to a container of storage and/or treatment of the pulp.

BACKGROUND OF THE INVENTION

In a container for a flow of pulp it is often essential that the residence time of the pulp in the container be substantially the same for all portions of the pulp flowing through the container. This particularly applies to treatment of the pulp by an agent, for example in the bleaching of the pulp. It is, thus, essential to avoid channelization in the container. During the treatment of the pulp with an agent, which is supplied prior to the supply of the pulp to the container, it is also important that the agent be distributed uniformly in the pulp at the inlet to the container, in order to thereby achieve homogenous treatment. It has thus been found that the way in which the pulp is supplied to the container is of decisive importance for the solution of the aforesaid problems.

During the supply of pulp, different types of distributors are used. For example, these include mechanical distributors with an inlet housing and an axial rotor, the shaft of which is supported in bearings and sealed by a packing box. A gear and a motor are thus required for driving the rotor.

Mechanical distributors are also used, in which a rotor is formed with two or more outlet channels.

These mechanical distributors generally require a complicated design, because they comprise a rotor with an accessory drive, bearings, and a sealing arrangement. These distributors are also not adapted to varying pulp flows and production levels.

According to a somewhat simplified construction, a distributor is used which comprises a pump-like housing outside the container bottom, where at least four outlets are arranged symmetrically about the circumference of the container. Such a device requires a control valve in each outlet and separate pipe lines for connection to the container. This device is also very complicated, while its distribution effect is rather limited, and its flow direction is wrong.

In addition to the mechanical distributors, there also exist static distributors with conical surfaces for dispersing the pulp in the container. These distributors cannot be controlled, and the distribution achieved is often insufficient.

SUMMARY OF THE INVENTION

In accordance with the present invention these and other difficulties have now been overcome by the discovery of apparatus for the distribution of a pulp flow supplied to a container comprising an inlet for the pulp flow into one end of the container, a cylindrical wall disposed within the inlet and laterally defining a distribution chamber for the container, a surface member within the container facing the inlet spaced from the cylindrical wall and extending laterally at least to a location corresponding to the cylindrical wall thereby defining a gap between the surface member and the cylindrical wall whereby the pulp flow can pass laterally through the gap into the container for distribution therein, and gap adjusting means for adjusting the size of the gap. Preferably the surface member comprises a substantially planar surface.

In accordance with one embodiment of the apparatus of the present invention the surface member is stationary and the gap adjustment means comprises an auxiliary portion of the cylindrical wall for axially extending the cylindrical wall toward the surface member.

In accordance with another embodiment of the apparatus of the present invention the surface member is axially movable toward the cylindrical wall.

In accordance with another embodiment of the apparatus of the present invention the distribution chamber has a first cross-sectional area and the inlet has a second cross-sectional area, the first cross-sectional area being greater than the second cross-sectional area.

In accordance with the preferred embodiment of the apparatus of the present invention, the apparatus includes the plurality of guide plates radially disposed within the distribution chamber and attached to the surface member.

In accordance with another embodiment of the apparatus of the present invention the surface member includes a central portion, and the apparatus includes a movable shaft attached to the central portion of the surface member for axially moving the surface member.

In accordance with another embodiment of the apparatus of the present invention the apparatus includes treatment agent supply means connected to the distribution chamber for supplying a treatment agent to the distribution chamber.

In accordance with another embodiment of the apparatus of the present invention the apparatus includes a channel extending through the surface member and in communication with the container for evacuating gas from the container.

The present invention is directed to a distributing device of a simple design, which allows for control of the pulp flow and at the same time can also be used for closing the container. The distribution thus takes place from a central position outward to the circumference of the container uniformly across its cross-section.

BRIEF DESCRIPTION OF THE DRAWINGS

The present invention will be more fully appreciated with reference to the following detailed description which, in turn, refers to the accompanying drawings illustrating two embodiments of the apparatus of the present invention, as follows.

DETAILED DESCRIPTION

Figure 1:
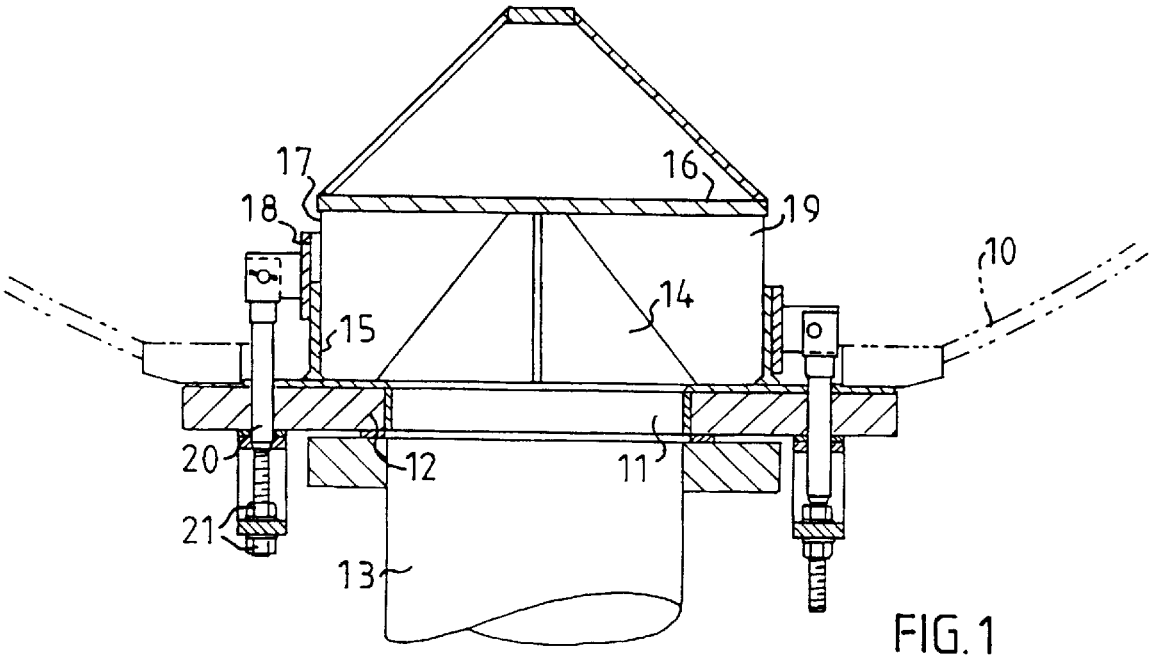
FIG. 1 is a side, partial, elevational, partially cross-sectional view of one embodiment of the apparatus of the present invention.

The apparatus shown in FIG. 1 is located centrally at one end of a container 10 for a pulp flow, preferably at the bottom of an upstream container. It is, however, also possible to connect the apparatus to the top of a downstream container. The device comprises an inlet 11 defined by an inlet flange 12, to which a supply line 13 for pulp is connected.

After the inlet 11, a distribution chamber 14 is located, which is defined in the lateral direction by a substantially cylindrical wall 15, and directly opposite the inlet 11 by a surface element 16. This surface element 16 preferably has a substantially planar surface, but different rotational symmetrical forms can also be imagined, for example a conical surface or a surface which is curved in some other way. The distribution chamber 14 communicates with the interior of the container 10 through an adjustable overall gap 17, which is defined between the wall 15 and surface element 16. The gap is adjustable in that a portion 18 of the wall 15 is axially movable and co-operates with the surface element 16, which is stationary.

The cross-sectional area of the distribution chamber 14 exceeds the cross-sectional area of the inlet 11. According to the embodiment shown, the surface element 16 is attached to a number of guide plates 19 arranged radially in the chamber 14.

The movable wall portion 18 is coupled to set screws 20, by which the wall portion 18, and thereby the gap 17, can be controlled. The set screws can be locked by nuts 21. The wall portion 18 can be formed so that the gap 17 can be closed completely.

Figure 2:
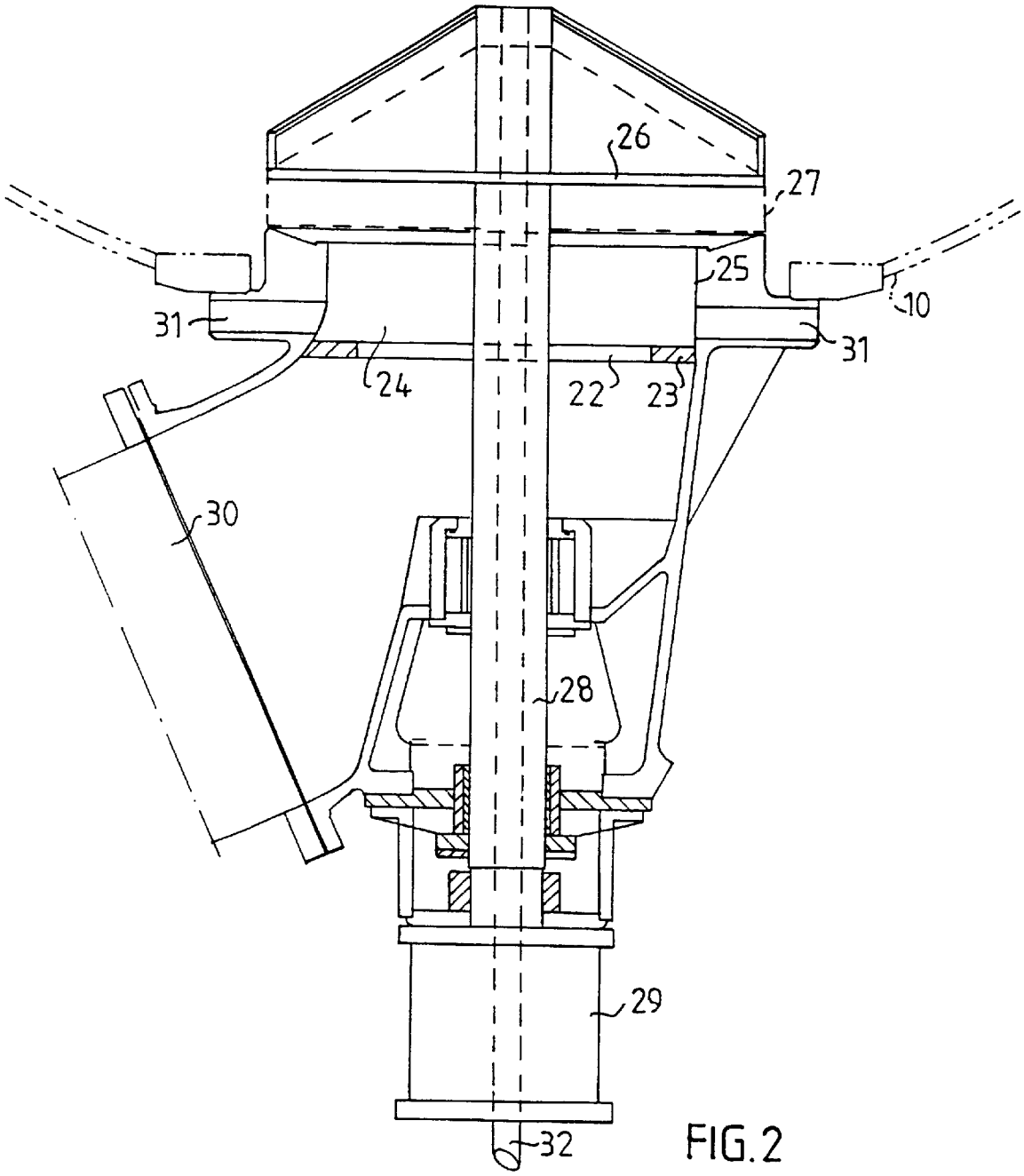
FIG. 2 is a side, elevational, partially sectional view of another embodiment of the apparatus of the present invention.

The device shown in FIG. 2 is also located centrally at one end of a container 10. It can be connected at the bottom of an upstream container or at the top of a downstream container. This device comprises an inlet 22 with a throttle ring 23. After the throttle ring 23 a distribution chamber 24 is located, which is defined in the lateral direction by a substantially cylindrical wall 25 and directly opposite to the inlet 22 by a surface element 26. This surface element preferably has a substantially planar surface, but other forms can also be imagined, as stated above with reference to the first embodiment. The distribution chamber 24 communicates with the interior of the container 10 through an adjustable overall gap 27, which is defined between the wall 25 and the surface element 26. The gap 27 is adjustable in that the surface element 26 is axially movable and co-operates with the stationary wall 25.

The cross-sectional area of the distribution chamber 24 exceeds the area of the inlet 21, i.e. the area at the opening in the throttle ring 23.

The surface element 26 is attached to a central shaft 28, which is axially movable by means of a set cylinder 29. The inlet 11 can be connected to a supply line 30 for pulp entering obliquely from the side. The size of the gap 27 is controlled by the surface element 26 so that it is possible to close the gap completely.

Supply lines 31 for treatment agent are connected to the distribution chamber 24. It is, however, also possible to add treatment agents to the pulp before the inlet 21. A channel 32 for the evacuation of gas from the pulp is located in the shaft 28. This channel 32 opens on the rear side of the surface element 26.

The pulp supplied through the supply lines, 13 and 30, passes through the inlet, 11 and 21, and throttling 23. From the distribution chambers, 14 and 24, the pulp flows through the adjustable gaps, 17 and 27, which effect throttling and distribution as well as dispersion of the pulp from a central position at the inlet end of the container 10 uniformly and smoothly outward across the cross-section of the container. The gaps, 17 and 27, are adjusted to the pulp flow in question.

Due to the fact that the gaps, 17 and 27, can be closed, it is possible to prevent return flow from the container 10.

The lines 31 for the supply of treatment agent allow the addition of the agent in question, such as a stream, gas and chemicals, in a place favorable for admixture which promotes the treatment of the pulp in the container.

Gas, for example, air, can be evacuated from the pulp through the channel 32 in cases when the pulp has an undesired gas content.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for the distribution of a pulp flow supplied to a container comprising an inlet for said pulp flow into one end of said container, a cylindrical wall disposed within said inlet and laterally defining a distribution chamber for said container, a surface member within said container facing said inlet spaced from said cylindrical wall and extending laterally at least to a location corresponding to said cylindrical wall thereby defining a gap between said surface member and said cylindrical wall whereby said pulp flow can pass laterally through said gap into said container for distribution therein, and gap adjusting means for adjusting the size of said gap.

2. The apparatus of claim 1 wherein said surface member comprises a substantially planar surface.

3. The apparatus of claim 1 wherein said surface member is stationary and said gap adjustment means comprises an auxiliary portion of said cylindrical wall for axially extending said cylindrical wall toward said surface member.

4. The apparatus of claim 3 including a plurality of guide plates radially disposed within said distribution chamber and attached to said surface member.

5. The apparatus of claim 1 wherein said surface member is axially movable towards said cylindrical wall.

6. The apparatus of claim 5 wherein said surface member includes a central portion, and including a movable shaft attached to said central portion of said surface member for axially moving said surface member.

7. The apparatus of claim 1 wherein said distribution chamber has a first cross-sectional area and said inlet has a second cross-sectional area, said first cross-sectional area being greater than said second cross-sectional area.

8. The apparatus of claim 1 including treatment agent supply means connected to said distribution chamber for supplying a treatment agent to said distribution chamber.

9. The apparatus of claim 1 including a channel extending through said surface member and in communication with said container for evacuating gas from said container.

* * * * *